US006595621B2

(12) United States Patent
Castano et al.

(10) Patent No.: US 6,595,621 B2
(45) Date of Patent: Jul. 22, 2003

(54) METHOD OF REDUCING VERTICAL BANDING IN INK JET PRINTING

(75) Inventors: Jorge Castano, Barcelona (ES); Xavier Girones, Tarragona (ES)

(73) Assignee: Hewlett-Packard Development Company, L.P., Fort Collins, CO (US)

( * ) Notice: Subject to any disclaimer, the term of this patent is extended or adjusted under 35 U.S.C. 154(b) by 0 days.

(21) Appl. No.: 09/871,966

(22) Filed: Jun. 4, 2001

(65) Prior Publication Data

US 2002/0180833 A1 Dec. 5, 2002

(51) Int. Cl.[7] ..... B41J 2/145
(52) U.S. Cl. ..... 347/41; 347/14
(58) Field of Search ..... 347/41, 12, 40, 347/15, 43, 16, 14, 19

(56) References Cited

U.S. PATENT DOCUMENTS 4,272,771 A * 6/1981 Furukawa ..... 347/41
6,290,328 B1 * 9/2001 Yamada et al. ..... 347/43

OTHER PUBLICATIONS

U.S. patent application Ser. No. 09/199,882, Gast et al., filed Nov. 24,1998, 347/43.

* cited by examiner

*Primary Examiner*—Lamson Nguyen
(74) *Attorney, Agent, or Firm*—Lee & Hayes, PLLC

(57) ABSTRACT

An ink jet printing process for removing or substantially hiding vertical bands which may be produced during a printing operation includes the application of a controlled variance to shift the horizontal position of certain ink drops fired from certain nozzles. That is, instead of firing ink drops from each of the nozzles simultaneously, the controlled variance causes the ink drops to be fired at various times after the firing signal has been received. The controlled variance may involve a mathematical formula applied to set the level of horizontal shift for each of the ink drops. Examples of suitable mathematical formulae include sinusoidal functions, Bessel functions, and Tschebysheff polynomials.

20 Claims, 11 Drawing Sheets

| | | | |
|---|---|---|---|
| 1 | 3 | 4 | 2 |
| 3 | 1 | 2 | 4 |
| 2 | 4 | 3 | 1 |
| 4 | 2 | 1 | 3 |

72

FIG. 12
*(PRIOR ART)*

| | | | | | | | | | | | |
|---|---|---|---|---|---|---|---|---|---|---|---|
| 25 | 9 | 1 | 17 | 25 | 9 | 1 | 17 | 25 | 9 | 1 | 17 |
| 10 | 26 | 18 | 2 | 10 | 26 | 18 | 2 | 10 | 26 | 18 | 2 |
| 19 | 3 | 11 | 27 | 19 | 3 | 11 | 27 | 19 | 3 | 11 | 27 |
| 4 | 20 | 28 | 12 | 4 | 20 | 28 | 12 | 4 | 20 | 28 | 12 |
| 29 | 13 | 5 | 21 | 29 | 13 | 5 | 21 | 29 | 13 | 5 | 21 |
| 14 | 30 | 22 | 6 | 14 | 30 | 22 | 6 | 14 | 30 | 22 | 6 |
| 23 | 7 | 15 | 31 | 23 | 7 | 15 | 31 | 23 | 7 | 15 | 31 |
| 8 | 24 | 32 | 16 | 8 | 24 | 32 | 16 | 8 | 24 | 32 | 16 |
| 1 | 17 | 9 | 25 | 1 | 17 | 9 | 25 | 1 | 17 | 9 | 25 |
| 18 | 2 | 26 | 10 | 18 | 2 | 26 | 10 | 18 | 2 | 26 | 10 |
| 27 | 11 | 19 | 3 | 27 | 11 | 19 | 3 | 27 | 11 | 19 | 3 |
| 12 | 28 | 4 | 20 | 12 | 28 | 4 | 20 | 12 | 28 | 4 | 20 |
| 5 | 21 | 13 | 29 | 5 | 21 | 13 | 29 | 5 | 21 | 13 | 29 |
| 22 | 6 | 30 | 14 | 22 | 6 | 30 | 14 | 22 | 6 | 30 | 14 |
| 31 | 15 | 23 | 7 | 31 | 15 | 23 | 7 | 31 | 15 | 23 | 7 |
| 16 | 32 | 8 | 24 | 16 | 32 | 8 | 24 | 16 | 32 | 8 | 24 |
| 9 | 25 | 17 | 1 | 9 | 25 | 17 | 1 | 9 | 25 | 17 | 1 |
| 26 | 10 | 2 | 18 | 26 | 10 | 2 | 18 | 26 | 10 | 2 | 18 |
| 3 | 19 | 27 | 11 | 3 | 19 | 27 | 11 | 3 | 19 | 27 | 11 |
| 20 | 4 | 12 | 28 | 20 | 4 | 12 | 28 | 20 | 4 | 12 | 28 |
| 13 | 29 | 21 | 5 | 13 | 29 | 21 | 5 | 13 | 29 | 21 | 5 |
| 30 | 14 | 6 | 22 | 30 | 14 | 6 | 22 | 30 | 14 | 6 | 22 |
| 7 | 23 | 31 | 15 | 7 | 23 | 31 | 15 | 7 | 23 | 31 | 15 |
| 24 | 8 | 16 | 32 | 24 | 8 | 16 | 32 | 24 | 8 | 16 | 32 |
| 17 | 1 | 25 | 9 | 17 | 1 | 25 | 9 | 17 | 1 | 25 | 9 |
| 2 | 18 | 10 | 26 | 2 | 18 | 10 | 26 | 2 | 18 | 10 | 26 |
| 11 | 27 | 3 | 19 | 11 | 27 | 3 | 19 | 11 | 27 | 3 | 19 |
| 28 | 12 | 20 | 4 | 28 | 12 | 20 | 4 | 28 | 12 | 20 | 4 |
| 21 | 5 | 29 | 13 | 21 | 5 | 29 | 13 | 21 | 5 | 29 | 13 |
| 6 | 22 | 14 | 30 | 6 | 22 | 14 | 30 | 6 | 22 | 14 | 30 |
| 15 | 31 | 7 | 23 | 15 | 31 | 7 | 23 | 15 | 31 | 7 | 23 |
| 32 | 16 | 24 | 8 | 32 | 16 | 24 | 8 | 32 | 16 | 24 | 8 |

FIG. 13
*(PRIOR ART)*

| | | | | | | | | | | | |
|---|---|---|---|---|---|---|---|---|---|---|---|
| -1.00 | 1.00 | 0.00 | 0.00 | -1.00 | 1.00 | 0.00 | 0.00 | -1.00 | 1.00 | 0.00 | 0.00 |
| 0.98 | -0.98 | -0.20 | 0.20 | 0.98 | -0.98 | -0.20 | 0.20 | 0.98 | -0.98 | -0.20 | 0.20 |
| -0.38 | 0.38 | 0.92 | -0.92 | -0.38 | 0.38 | 0.92 | -0.92 | -0.38 | 0.38 | 0.92 | -0.92 |
| 0.56 | -0.56 | -0.83 | 0.83 | 0.56 | -0.56 | -0.83 | 0.83 | 0.56 | -0.56 | -0.83 | 0.83 |
| -0.71 | 0.71 | 0.71 | -0.71 | -0.71 | 0.71 | 0.71 | -0.71 | -0.71 | 0.71 | 0.71 | -0.71 |
| 0.56 | -0.56 | -0.83 | 0.83 | 0.56 | -0.56 | -0.83 | 0.83 | 0.56 | -0.56 | -0.83 | 0.83 |
| -0.92 | 0.92 | 0.38 | -0.38 | -0.92 | 0.92 | 0.38 | -0.38 | -0.92 | 0.92 | 0.38 | -0.38 |
| 0.98 | -0.98 | -0.20 | 0.20 | 0.98 | -0.98 | -0.20 | 0.20 | 0.98 | -0.98 | -0.20 | 0.20 |
| 0.00 | 0.00 | 1.00 | -1.00 | 0.00 | 0.00 | 1.00 | -1.00 | 0.00 | 0.00 | 1.00 | -1.00 |
| -0.20 | 0.20 | -0.98 | 0.98 | -0.20 | 0.20 | -0.98 | 0.98 | -0.20 | 0.20 | -0.98 | 0.98 |
| -0.92 | 0.92 | -0.38 | 0.38 | -0.92 | 0.92 | -0.38 | 0.38 | -0.92 | 0.92 | -0.38 | 0.38 |
| 0.83 | -0.83 | 0.56 | -0.56 | 0.83 | -0.83 | 0.56 | -0.56 | 0.83 | -0.83 | 0.56 | -0.56 |
| 0.71 | -0.71 | 0.71 | -0.71 | 0.71 | -0.71 | 0.71 | -0.71 | 0.71 | -0.71 | 0.71 | -0.71 |
| -0.83 | 0.83 | -0.56 | 0.56 | -0.83 | 0.83 | -0.56 | 0.56 | -0.83 | 0.83 | -0.56 | 0.56 |
| -0.38 | 0.38 | -0.92 | 0.92 | -0.38 | 0.38 | -0.92 | 0.92 | -0.38 | 0.38 | -0.92 | 0.92 |
| 0.20 | -0.20 | 0.98 | -0.98 | 0.20 | -0.20 | 0.98 | -0.98 | 0.20 | -0.20 | 0.98 | -0.98 |
| 1.00 | -1.00 | 0.00 | 0.00 | 1.00 | -1.00 | 0.00 | 0.00 | 1.00 | -1.00 | 0.00 | 0.00 |
| -0.98 | 0.98 | 0.20 | -0.20 | -0.98 | 0.98 | 0.20 | -0.20 | -0.98 | 0.98 | 0.20 | -0.20 |
| 0.38 | -0.38 | -0.92 | 0.92 | 0.38 | -0.38 | -0.92 | 0.92 | 0.38 | -0.38 | -0.92 | 0.92 |
| -0.56 | 0.56 | 0.83 | -0.83 | -0.56 | 0.56 | 0.83 | -0.83 | -0.56 | 0.56 | 0.83 | -0.83 |
| 0.71 | -0.71 | -0.71 | 0.71 | 0.71 | -0.71 | -0.71 | 0.71 | 0.71 | -0.71 | -0.71 | 0.71 |
| -0.56 | 0.56 | 0.83 | -0.83 | -0.56 | 0.56 | 0.83 | -0.83 | -0.56 | 0.56 | 0.83 | -0.83 |
| 0.92 | -0.92 | -0.38 | 0.38 | 0.92 | -0.92 | -0.38 | 0.38 | 0.92 | -0.92 | -0.38 | 0.38 |
| -0.98 | 0.98 | 0.20 | -0.20 | -0.98 | 0.98 | 0.20 | -0.20 | -0.98 | 0.98 | 0.20 | -0.20 |
| 0.00 | 0.00 | -1.00 | 1.00 | 0.00 | 0.00 | -1.00 | 1.00 | 0.00 | 0.00 | -1.00 | 1.00 |
| 0.20 | -0.20 | 0.98 | -0.98 | 0.20 | -0.20 | 0.98 | -0.98 | 0.20 | -0.20 | 0.98 | -0.98 |
| 0.92 | -0.92 | 0.38 | -0.38 | 0.92 | -0.92 | 0.38 | -0.38 | 0.92 | -0.92 | 0.38 | -0.38 |
| -0.83 | 0.83 | -0.56 | 0.56 | -0.83 | 0.83 | -0.56 | 0.56 | -0.83 | 0.83 | -0.56 | 0.56 |
| -0.71 | 0.71 | -0.71 | 0.71 | -0.71 | 0.71 | -0.71 | 0.71 | -0.71 | 0.71 | -0.71 | 0.71 |
| 0.83 | -0.83 | 0.56 | -0.56 | 0.83 | -0.83 | 0.56 | -0.56 | 0.83 | -0.83 | 0.56 | -0.56 |
| 0.38 | -0.38 | 0.92 | -0.92 | 0.38 | -0.38 | 0.92 | -0.92 | 0.38 | -0.38 | 0.92 | -0.92 |
| -0.20 | 0.20 | -0.98 | 0.98 | -0.20 | 0.20 | -0.98 | 0.98 | -0.20 | 0.20 | -0.98 | 0.98 |

FIG. 14

METHOD OF REDUCING VERTICAL BANDING IN INK JET PRINTING

FIELD OF THE INVENTION

This invention relates generally to inkjet printers. More particularly, the invention relates to a technique for improving the quality of inkjet printing systems by introducing a controlled variance in a scan axis to thus hide vertical bands that may form during the printing process.

BACKGROUND OF THE INVENTION

U.S. application Ser. No. 09/199,882, filed Nov. 24, 1998, entitled "Alignment of Ink Dots in an Inkjet Printer," by Paul D. Gast et al., is assigned to the present assignee and incorporated herein by reference in its entirety. That application discloses a technique for compensating for misalignment that may occur during printing operations. In this respect, according to the disclosed technique, a test pattern is printed to determine whether any compensation for misalignment is required during the printing of a plot. Offset errors are introduced during the printing of the plot to compensate for misalignment. Thus, that application pertains to the reduction of misalignment that may occur during printing and thus is not concerned with the reduction of vertical banding.

FIG. 1 is a simplified example of a conventional inkjet printer 10. This example will be used to illustrate some of the problems associated with known ink jet printers. As illustrated in FIG. 1, conventional ink jet printer 10 includes an input tray 12 containing sheets of print medium (e.g., paper) 14 which pass through a print zone 15 for being printed upon. The print medium 14 is then forwarded to an output tray 16. A movable carriage 20 holds print cartridges 22, 24, 26, and 28, which may hold various colored inks, in addition to black ink. The carriage 20 is traversed along a scan axis by a belt and pulley system and slides along slide rod 30.

In use, printing signals from an external computer (not shown) are processed by inkjet printer 10 to generate a bitmap of the dots to be printed. The bitmap is then converted into firing signals for the printhead. The position of the carriage 20 as it traverses back and forth along the scan axis is determined from an optical encoder strip 32, detected by a photoelectric element on carriage 20, to cause the various ink ejection elements on each printer cartridge to be selectively fired at the proper time during the carriage scan.

FIG. 2 illustrates the printhead portion of a print cartridge, such as print cartridge 22 in FIG. 1, while FIG. 3 is a top down detailed view of a nozzle plate 34 on the print cartridge. Three hundred nozzles 35 arranged in two vertical rows 38 are shown in FIG. 3. The primitives P1–P14 are labeled on the nozzle plate 34. The print cartridge 22 has contact pads 36 formed on a circuit which electrically contact electrodes in cartridge 20 for receiving power and ground signals as well as the firing signals for the various ink ejection elements.

FIG. 4 illustrates a portion of the printhead substrate, underneath nozzle plate 34, associated with a single primitive. The printhead substrate is typically a rectangular piece of silicon having formed on it ink channels 40, ink ejection chambers 42, and heater resistors 44 using photolithographic techniques. The various ink channels 40 and chambers 42 are formed by a barrier layer 45 of photoresist. Each chamber 42 is operable to receive ink via an associated ink channel 40. When current passes through a heater resistor 44, the received ink is vaporized to cause a droplet of ink to be ejected by an associated nozzle 35.

To accurately print onto a print medium, the printheads of the ink jet printer devices must be accurately positioned over that portion of the print medium to which it is to print. In addition, the heater resistor 44 must be fired at the correct moment as the printhead is moved along the scan axis. Small inaccuracies due to uncontrolled movements, oscillations, etc., may allow for any faults in the printing output to become visible. Moreover, because the printheads are generally mounted in a mechanical part that moves over the print medium, errors occurring due to the printhead movements over the print medium may additionally adversely affect the accuracy and thus the quality of the printed output.

One manner in which conventional ink jet printer devices attempt to address the above-stated inaccuracies is to utilize a multi-pass printing process. In a multi-pass printing process, each part of the printing output is printed using a different part of the printhead. That is, with reference to FIG. 3, each part of the printed output for a given pass is printed with a different nozzle 35. As illustrated in FIG. 5, the multi-pass printing method makes multiple passes 46–52, with the print medium making small advancing movements in the direction 54 between the passes, to generate the desired images. Thus, a desired image is printed with the printhead making a first pass 46 in a scan axis, a second pass 48 in a scan axis, etc. By virtue of the multi-pass printing technique, those areas in which malfunctioning nozzles are to print may be printed upon by at least one functioning nozzle.

However, the multi-pass printing method is not completely immune from defects which may occur during a printing process. By virtue of a plurality of factors, the directionality and placement of the nozzles may become somewhat skewed. For example, if there are any sudden changes in the friction force or defects in the surfaces over which the carriage 20 runs, some oscillations or mechanical shifts may give rise to directionality and placement errors. Additionally, the electrical cables that connect the carriage electronics with external electronics may change the electrical properties (e.g., RC time constants) when the carriage 20 runs along the scan axis. This changes the time delay of the signal transmitted through the cables, thus potentially shifting the time for firing the drops of ink and may give rise to placement errors. In this respect, the placement errors may be effectuated each time the printhead 22–28 makes a pass to print an image. Thus, as illustrated in FIG. 6, this may result in the formation of vertical bands 56 during a printing operation which implements the multi-pass process.

The vertical bands 56 illustrated in FIG. 6 may result from the row of nozzles 38 being fired simultaneously. As illustrated in FIG. 7, reference numeral 38 represents a row of nozzles which are configured to travel in a scan axis direction 58. When there is an error 60, e.g., a fly time delay, mechanical shift, or the like, each of the nozzles 35 in the row of 38 typically fire ink drops 62 some time after the fire signal 64 is received by the printhead 22–28 indicated by arrow 66. In this instance, a vertical row of ink drops may be fired according to the error 60 each time the printhead makes a pass across the scan axis. This may result in the formation of the vertical bands 56 throughout the printed image 55 as illustrated in FIG. 8.

Accordingly, known multi-pass printing methods have been relatively inadequate to print images on print media without vertical bands when errors occur and therefore, known multi-pass printing methods suffer from a variety of drawbacks and disadvantages.

SUMMARY OF THE INVENTION

According to one aspect, the present invention pertains to a method of reducing vertical banding in a multi-pass printing process. The multi-pass printing process utilizes a printhead having a plurality of nozzles positioned in a substantially non-linear arrangement along a surface of the printhead. The nozzles are operable to fire an ink drop within a predetermined time in response to receipt of a fire signal during each pass of said multi-pass printing process. In the method, a controlled variance is introduced to vary the predetermined time of firing of the ink drop. The controlled variance is configured to vary the predetermined time of firing the ink drop for each pass of the multi-pass printing process.

In accordance with another aspect, the present invention relates to a method of operating a printer device to print onto a print medium. In the method, a first firing sequence is signaled to a first set of nozzles in the printer device to fire an ink drop during a first pass of the nozzles over a first portion of the print medium. The first set of nozzles are operable to fire an ink drop within a predetermined time in response to receipt of the first firing sequence signal. A first controlled variance is introduced to vary the predetermined time of firing of the ink drop in response to receipt of the first firing sequence signal. A second firing sequence is signaled to a second set of nozzles in the printer device to fire an ink drop during a second pass of the nozzles over a second portion of the print medium. The second set of nozzles are operable to fire an ink drop within a predetermined time in response to receipt of the second firing sequence signal. Additionally, a second controlled variance is introduced to vary the predetermined time of firing of the ink drop in response to receipt of the second firing sequence signal.

In accordance with another aspect, the present invention relates to an ink jet printer device configured to print an image by utilizing a multi-pass printing process. The device includes a means for firing an ink drop at a predetermined time following receipt of a fire signal. A means for varying the predetermined time of firing the ink drop in response to receipt of the fire signal, in which the predetermined time of firing the ink drop varies for each pass in the multi-pass printing process.

In comparison to known printing methods, certain embodiments of the present invention are capable of achieving certain advantages, such as, substantially reducing the formation of vertical bands which may occur during printing processes.

BRIEF DESCRIPTION OF THE DRAWINGS

Features and advantages of the present invention will become apparent to those skilled in the art from the following description with reference to the drawings, in which:

FIG. 12 illustrates a table depicting a conventional sequence of printing output in four pass printing technique;

FIG. 13 illustrates a representation of a conventional printing area utilizing the table depicted in FIG. 12 as a legend, with a printhead having 32 nozzles, in which, the shading of each nozzle number represents the pass number in which the respective nozzle may be fired; and FIG. 14 is a tabular representation of the image created by a multi-pass printing process illustrated in FIG. 13, in which, a controlled positional variance has been introduced.

DETAILED DESCRIPTION OF THE INVENTION

For simplicity and illustrative purposes, the principles of the present invention are described by referring mainly to an exemplary embodiment thereof, particularly with references to an example of an inkjet printer device. However, one of ordinary skill in the art would readily recognize that the same principles are equally applicable to, and can be implemented in, any printing device that utilizes a plurality of nozzles to fire drops of ink onto a print medium, and that any such variation would be within such modifications that do not depart from the true spirit and scope of the present invention.

Figure 1:
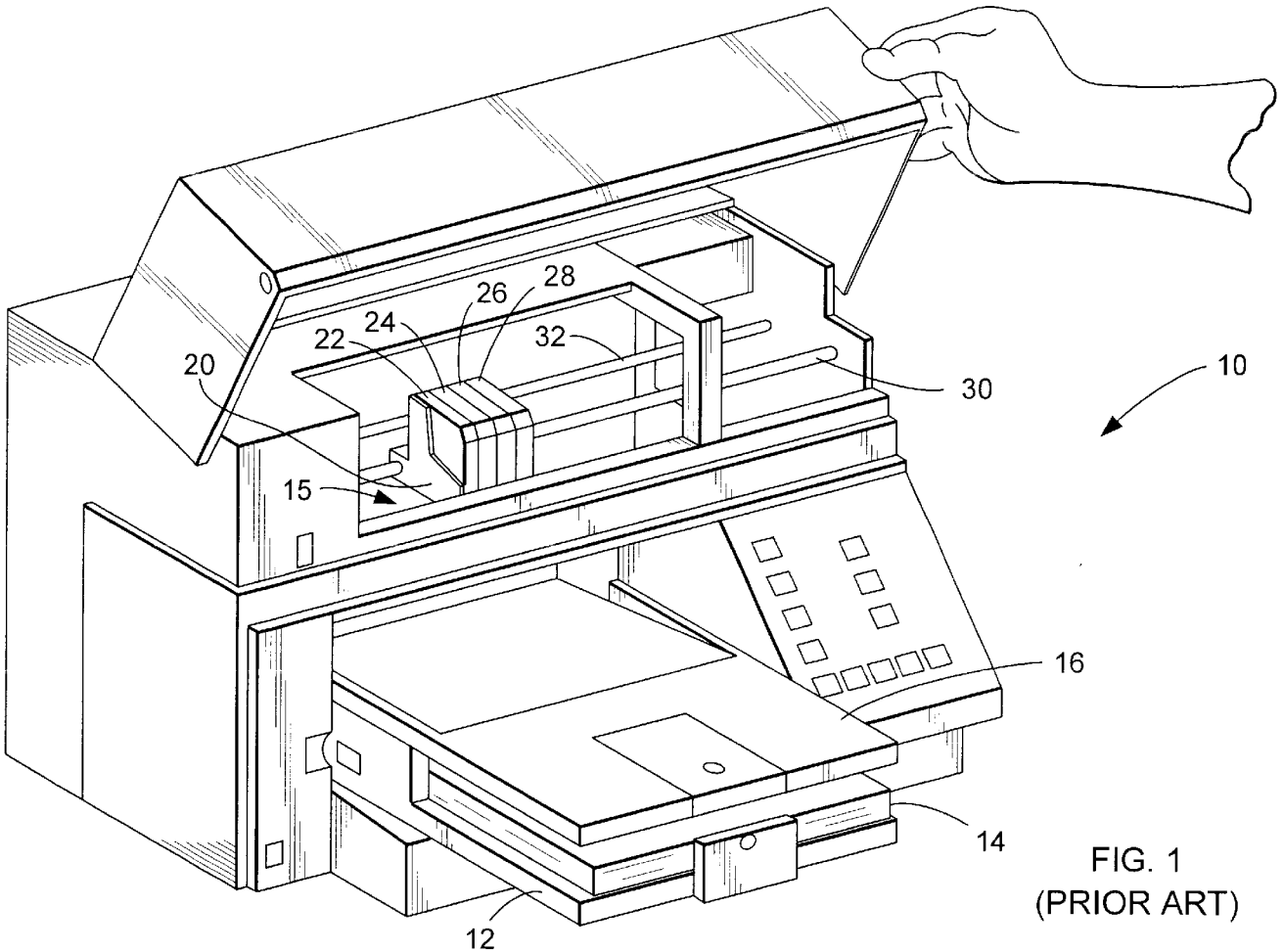
FIG. 1 (PRIOR ART)
FIG. 1 illustrates a conventional ink jet printer device.
Figure 2:
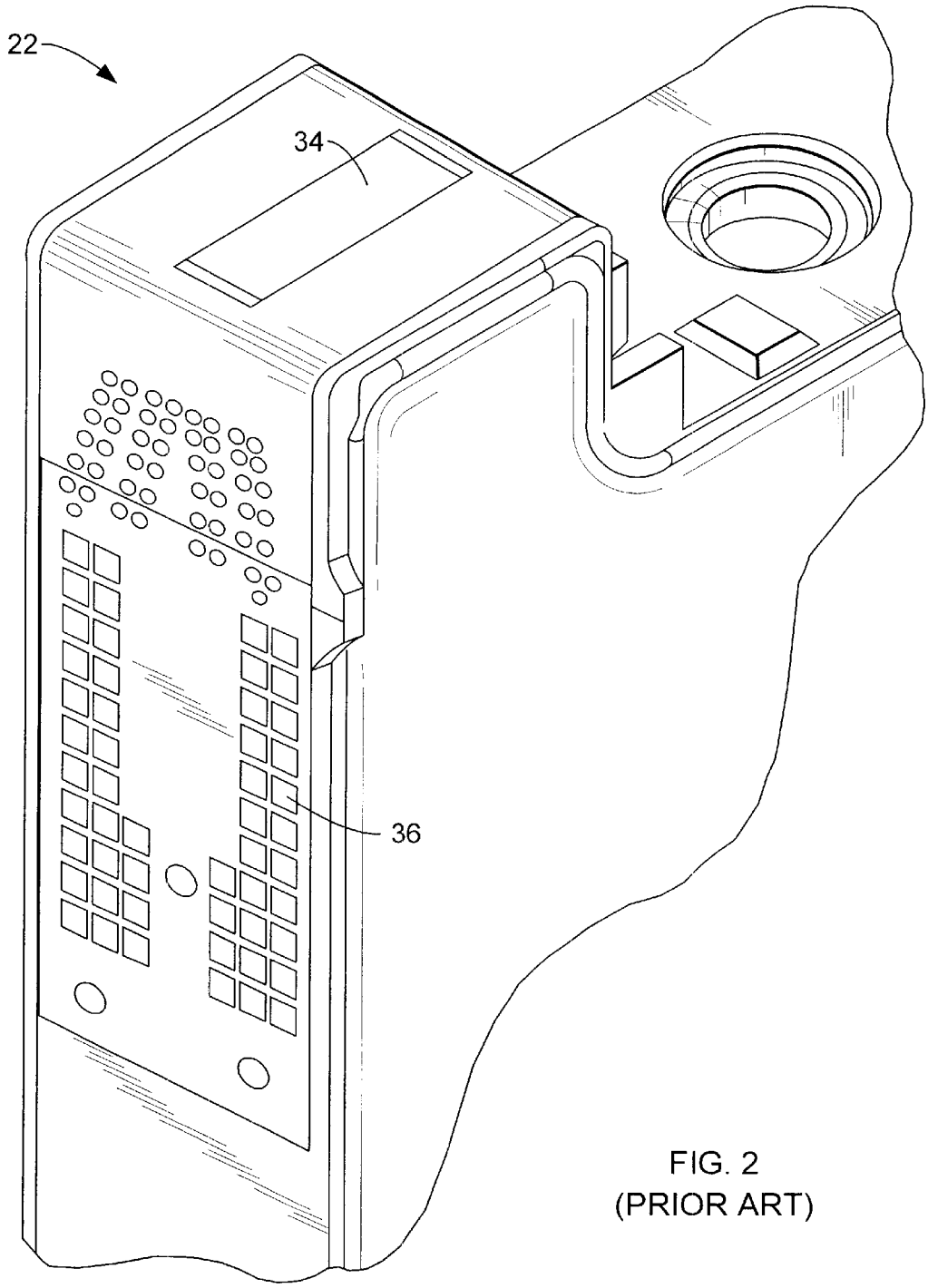
FIG. 2 (PRIOR ART)
FIG. 2 illustrates a conventional printhead operable for use in the ink jet printer device depicted in FIG. 1.
Figure 3:
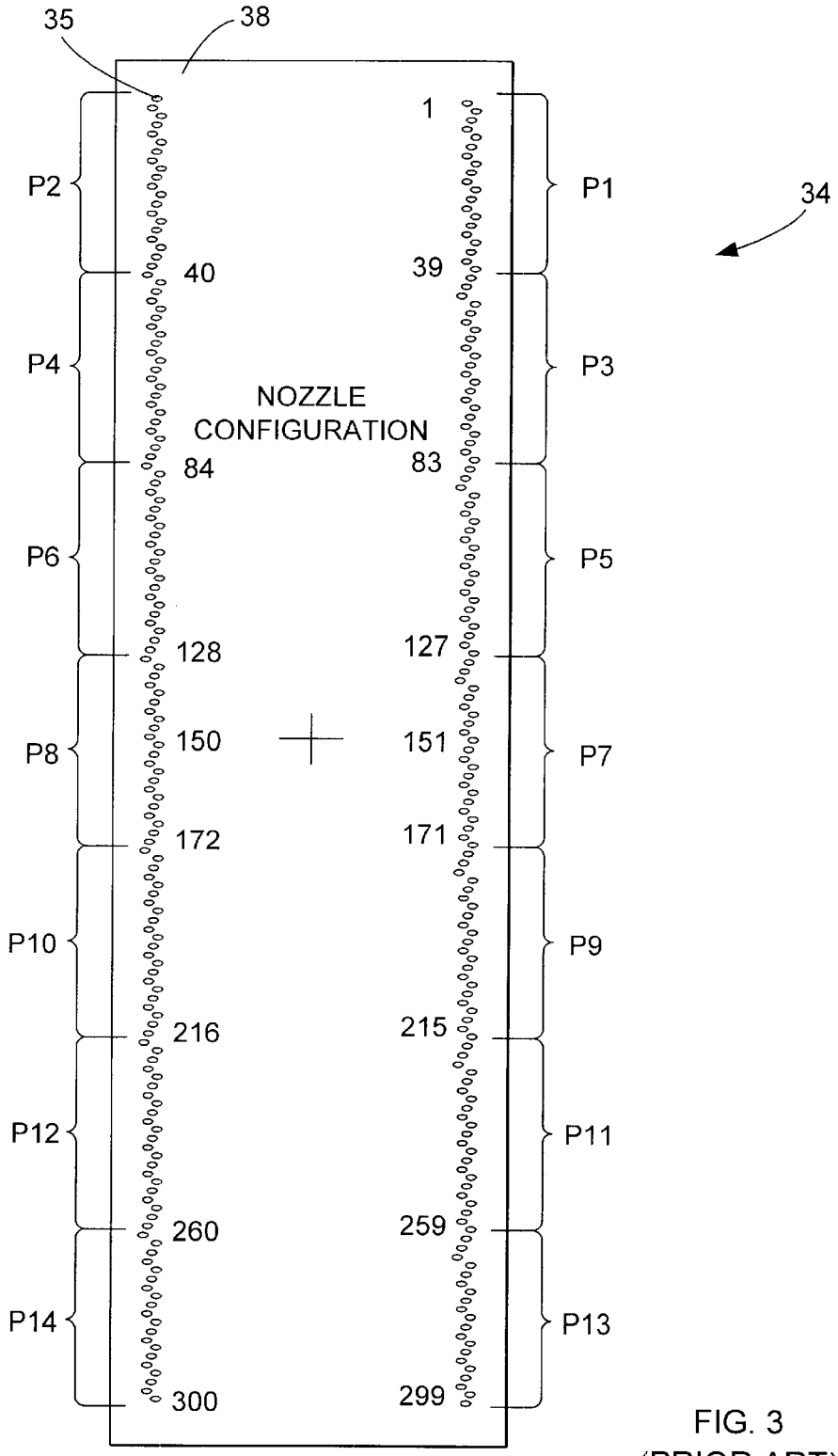
FIG. 3 (PRIOR ART)
FIG. 3 illustrates a nozzle configuration of the conventional printhead illustrated in FIG. 2.
Figure 4:
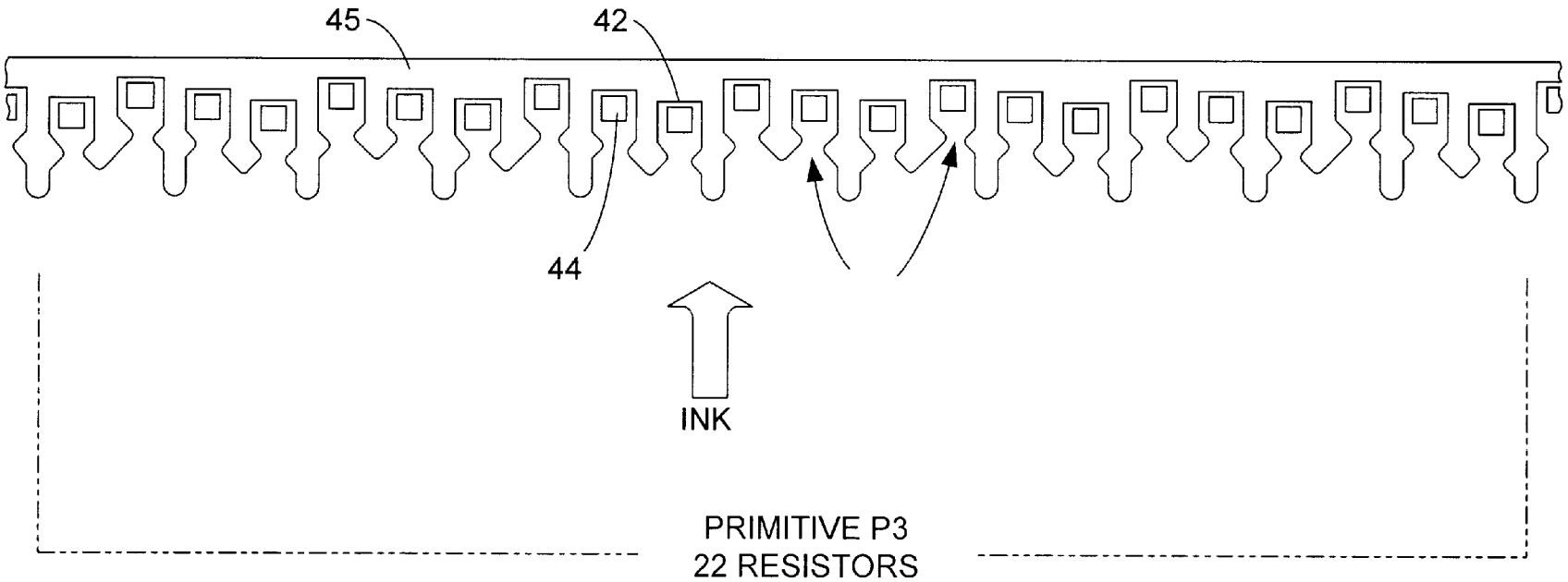
FIG. 4 (PRIOR ART)
FIG. 4 illustrates a conventional printhead substrate, of the printhead shown in FIG. 3, depicting a plurality of firing resistors.
Figure 5:
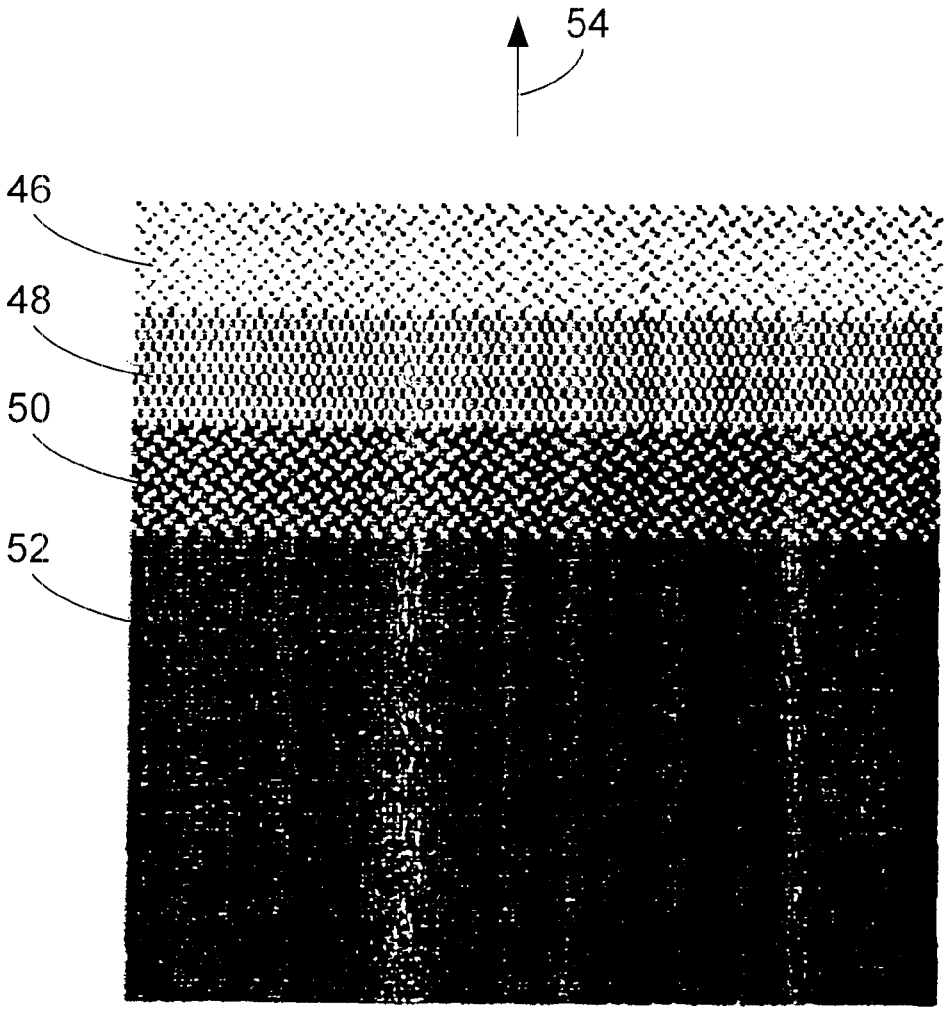
FIG. 5 (PRIOR ART)
FIG. 5 illustrates a conventional multi-pass printing method.
Figure 6:
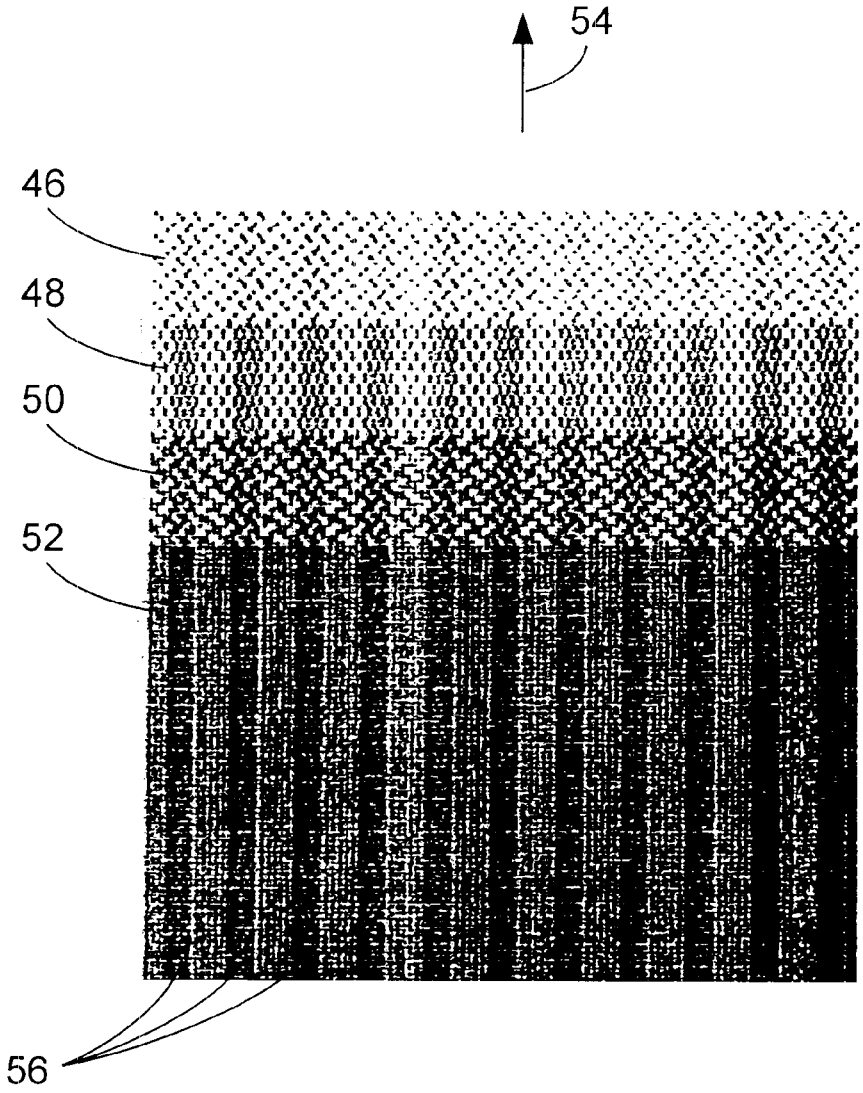
FIG. 6 (PRIOR ART)
FIG. 6 illustrates vertical banding which may occur in using a conventional multi-pass printing method.
Figure 7:
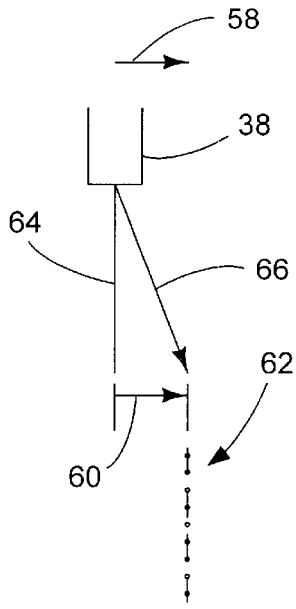
FIG. 7 (PRIOR ART)
FIG. 7 illustrates a manner in which a vertical band depicted in FIG. 6 may be formed.
Figure 9:
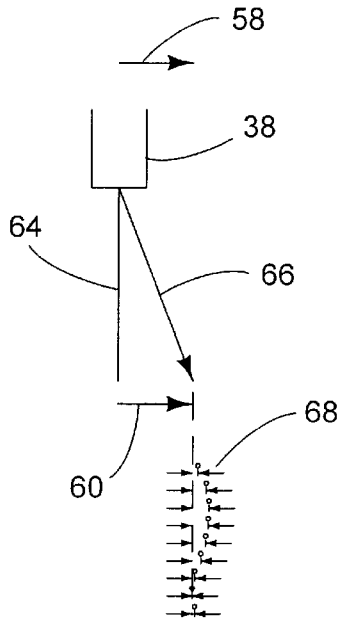
FIG. 9 illustrates a manner in which a controlled variance may be introduced during a printing process according to the principles of the present invention.

According to the principles of the present invention, a controlled variance is introduced into an ink jet printer device during the printing of an image (e.g., text, plots, etc.). In one respect, the controlled variance is applied to the printing process to remove or substantially hide vertical bands that may be produced during a printing operation, as illustrated in FIG. 9. As seen in FIG. 9, reference numeral 38 represents a row of nozzles which are configured for travel along a scan axis 58. A firing signal 64 is sent to the nozzles 38, typically by a computer (not shown), to eject ink onto a print medium, e.g., paper. An error 60, e.g., a fly time delay, mechanical shift, or the like, may occur from the time the firing signal 64 is received and the time the nozzles of the row of nozzles 38 fire ink drops. At the time a nozzle in the row of nozzles 38 fires an ink drop, as indicated by arrow 66, the row of nozzles 38 may have shifted to a position relatively farther along the scan axis 58 than was originally intended when the firing signal 64 was received by the nozzles. In comparison to a conventional manner of firing ink drops 62 from a plurality of nozzles illustrated in FIG. 7, as seen in FIG. 9, the ink drops 68 are arranged in a generally curved shape. That is, a controlled variance has been introduced into the row of nozzles 38 in FIG. 9, such that, the nozzles do not fire ink drops in the manner depicted in FIG. 7, i.e., simultaneously, but rather, each of the nozzles fires an ink drop 68 at various distances from the position where the firing signal 64 was received.

Figure 10:
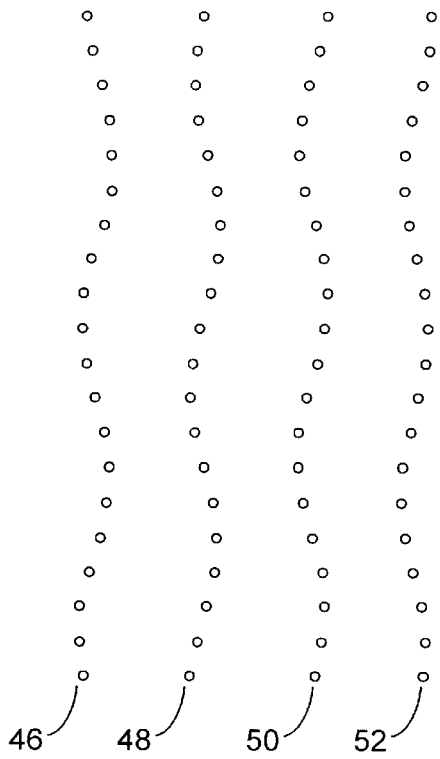
FIG. 10 is an enlarged view depicting a manner in which an applied controlled variance may be somewhat altered for each pass in a multi-pass printing method according to the principles of the present invention.

Furthermore, a controlled variance may be introduced during each pass 46–52 in a multi-pass printing process, as illustrated in FIG. 10. FIG. 10 is an enlarged view depicting a manner in which a controlled variance may be altered for each pass in a multi-pass printing process. In this respect, according to a preferred embodiment of the present invention, the controlled variance applied to each pass 46–52 may vary to generally prevent vertical banding as well as banding caused by shifting each of the passes in the same manner. However, it is envisioned that the same controlled variance may be introduced into each pass without deviating from the scope and spirit of the present invention.

Figure 8:
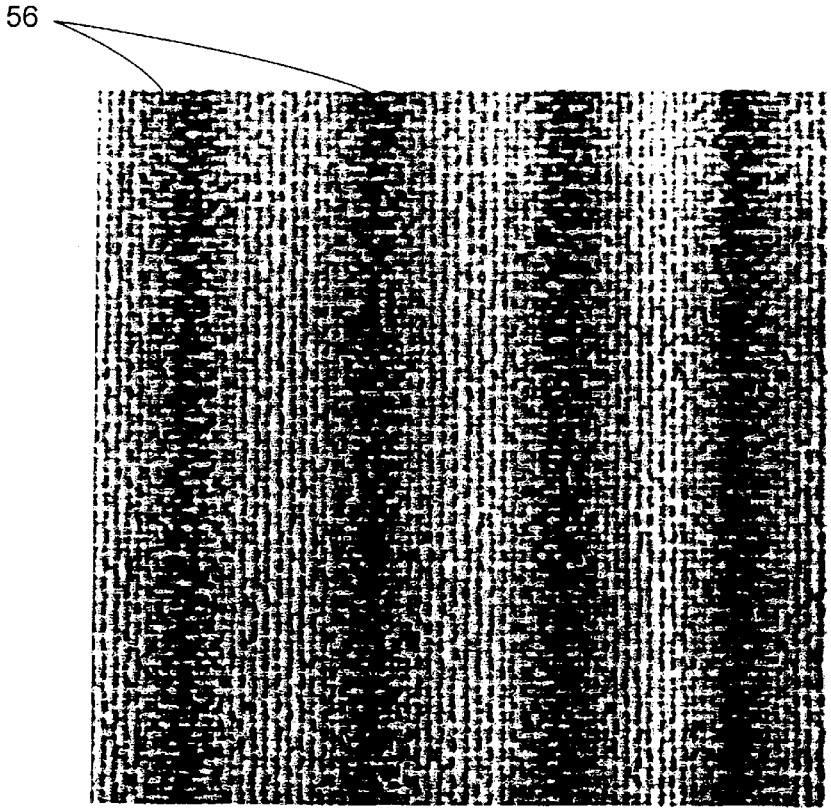
FIG. 8 (PRIOR ART)
FIG. 8 is an enlarged view of a printed image in which vertical banding has occurred in a conventional printing method.
Figure 11:
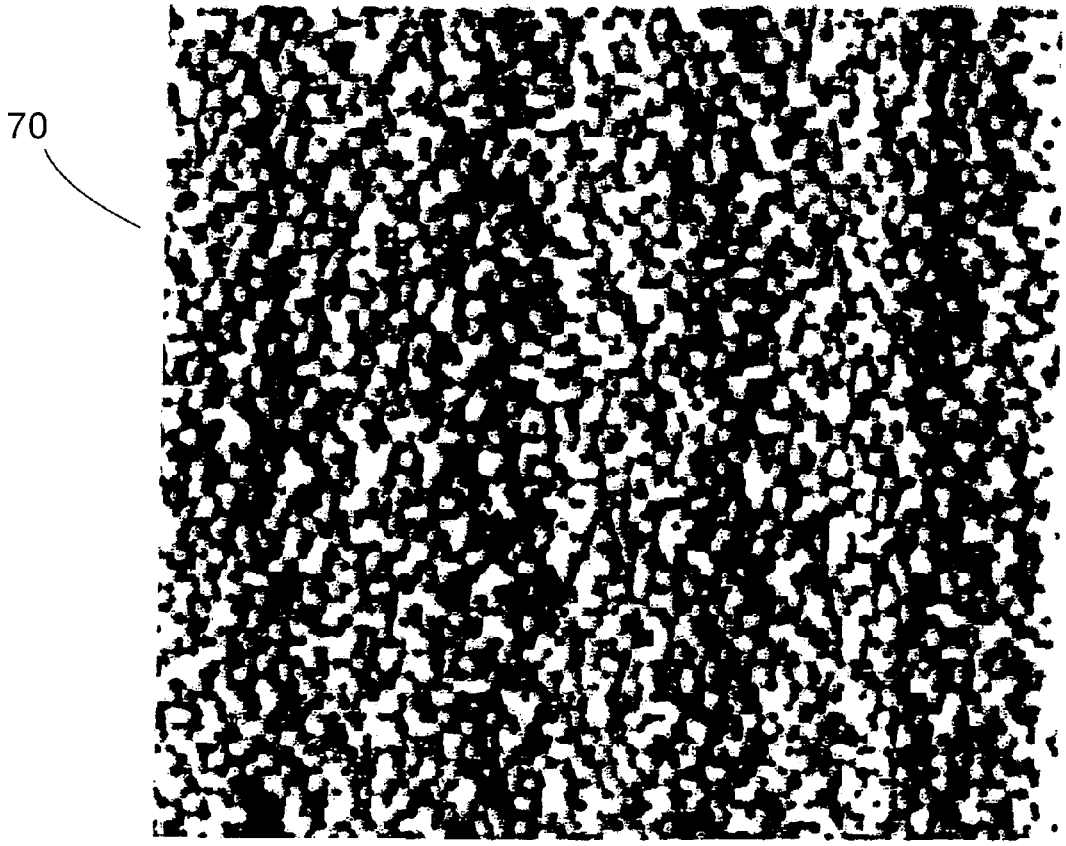
FIG. 11 is an enlarged view of a printed image in which a controlled variance was applied in the printing process to thereby substantially reduce vertical banding which may occur during a multi-pass printing process.

FIG. 11 is an enlarged view of a printed image 70, in which, a controlled variance was introduced into the printing process to thereby substantially reduce vertical banding which may occur during a multi-pass printing output. In producing the printed image illustrated in FIG. 11, a different controlled variance was introduced into each pass of a multi-pass printing process. In comparison to FIG. 8, the vertical banding which may occur by virtue of errors that may arise during a printing process as described hereinabove may be virtually eliminated by introducing controlled variances during the printing operation of a row of nozzles in a printhead as illustrated in FIG. 11.

FIG. 12 illustrates a table depicting a conventional sequence of printing output in a multi-pass printing process in which four passes are made. As illustrated in FIG. 12, those sections of the table labeled "1" correspond to those sections of the print medium upon which ink is dropped in a first pass. Those sections of the table labeled "2" correspond to those sections of the print medium upon which ink is dropped in a second pass. In a similar fashion, the sections labeled "3" and "4" correspond to third and fourth passes, respectively. In addition, as illustrated in FIG. 12, each of the passes is depicted with a certain background design. For example, the first passes are labeled as "1" and also includes a diagonally striped background. Moreover, the second passes are labeled as "2" and also includes a horizontally striped background, whereas the third passes are labeled as "3" and includes a dotted background. The fourth passes have been labeled "4" and also includes a plain background. As will become apparent from the following discussion of the table illustrated in FIG. 13, FIG. 12 is a legend for FIG. 13.

The table illustrated in FIG. 13 represents a conventional technique of operating the nozzles in a printhead having 32 nozzles during a multi-pass printing operation. In the table illustrated in FIG. 13, each of the numbers represents a nozzle in the printhead having 32 nozzles. As seen in FIG. 13, each of the nozzle numbers is provided with a background that corresponds to those backgrounds illustrated in FIG. 12. In this respect, the background design illustrated for each of the nozzle numbers in the table illustrated in FIG. 13 corresponds to the pass number in FIG. 12. Thus, for example, in the top left corner of FIG. 13, it is seen that nozzle number "25" fires an ink drop during the first pass and the nozzle number "10" fires an ink drop during the third pass. By virtue of the multi-pass printing process employed in creating an image represented by those numbers recited in FIG. 13, when any of the nozzles of the printhead malfunctions, those sections of the image upon which the malfunctioning nozzle is to fire an ink drop may be printed upon by a functioning nozzle during a subsequent pass.

According to the principles of the present invention, a controlled variance, such as an artificial shift is introduced into the horizontal positioning of the fired drops. In this respect, the artificial shift may follow a mathematical formula (e.g., sinusoidal, Bessel functions, Tschebysheff polynomials, etc.). For example, if a sinusoidal function is utilized, the following formula may be utilized to create the artificial shift:

$$Shift_i = Amp * Sin((i-1)*2*\pi/n) \quad i \subset [1 \ldots n]$$

In the formula cited above, "$Shift_i$" represents the error introduced into the nozzle number "i" (in which the number "i" represents the set from 1 to the number of nozzles in the printhead "n"). "Amp" represents the maximum error to be applied to the nozzle set. "Sin" represents the sine function. In operation, for example, the above formula is applied to all of the nozzles of the printhead.

Thus, a controlled variance is introduced into the conventional printing scheme of FIG. 13 by application of the above-cited formula. An application of the controlled error implementing the above-cited formula is illustrated in FIG. 14. In FIG. 14, the degree to which each of the nozzles may be shifted is based upon an amplitude (Amp) of one (1). The controlled variance applied to each of the nozzles 38 in printing each of the columns in FIG. 14 during each pass of a multi-pass printing process is varied with respect to the other passes of the multi-pass printing process. Accordingly, the manner in which the ink drops are fired is similar to the multi-pass printing process illustrated in FIG. 10.

As illustrated in FIG. 14, when the mathematical formula recited above is implemented in the conventional printing scheme illustrated in FIG. 13, a controlled variance may be established in each column to substantially overcome certain drawbacks and disadvantages associated with known multi-pass printing techniques.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method of reducing vertical banding in a multi-pass printing process, wherein said multi-pass printing process utilizes a printhead having a plurality of nozzles positioned in a substantially non-linear arrangement along a surface of said printhead, said nozzles being operable to fire an ink drop within a predetermined time in response to receipt of a fire signal during at least one pass of said multi-pass printing process, said method comprising the steps of:

introducing a controlled variance to vary said predetermined time of firing of said ink drop; and fluctuating said controlled variance to vary said predetermined time of firing of said ink drop for said at least one pass of said multi-pass printing process.

2. The method according to claim 1, wherein said controlled variance introduction step comprises the step of shifting a position of the firing of said ink drop.

3. The method according to claim 2, wherein said shifting step comprises the further step of shifting said position of the firing of said ink drop in a horizontal direction.

4. The method according to claim 2, wherein said shifting step comprises the further step of shifting said position of the firing of said ink drop prior to or following said predetermined time in response to receipt of said fire signal.

5. The method according to claim 2, wherein said shifting step further comprises the step of applying a mathematical formula.

6. The method according to claim 5, wherein said mathematical formula applying step comprises the further step of applying at least one of a sinusoidal function, a Bessel function, and a Tschebysheff polynomial.

7. A method of operating a printer device to print onto a print medium comprising the steps of:

signaling a first firing sequence to a first set of nozzles in said printer device to fire an ink drop during a first pass of said nozzles over a first portion of said print medium, wherein said first set of nozzles are operable to fire said ink drop within a predetermined time in response to receipt of said first firing sequence signal;

introducing a first controlled variance to vary said predetermined time of firing of said ink drop in response to receipt of said first firing sequence signal;

signaling a second firing sequence to a second set of nozzles in said printer device to fire an ink drop during a second pass of said nozzles over a second portion of said print medium, wherein said second set of nozzles are operable to fire said ink drop within a predetermined time in response to receipt of said second firing sequence signal; and introducing a second controlled variance to vary said predetermined time of firing of said ink drop in response to receipt of said second firing sequence signal.

8. The method according to claim 7, wherein said first controlled variance introduction step further comprises the step of shifting the position of the firing of said ink drop in response to receipt of said first firing sequence signal, and wherein said second controlled variance introduction step further comprises the step of shifting the position of the firing of said ink drop in response to receipt of said second firing sequence signal.

9. The method according to claim 8, further comprising the step of varying the shifted position of the firing of said ink drop in response to receipt of said first firing sequence signal with respect to the shifted position of the firing of said ink drop in response to receipt of said second firing sequence signal.

10. The method according to claim 8, wherein said shifting step comprises the further steps of shifting said position of the firing of said ink drop in response to receipt of said first firing sequence signal in a horizontal direction, and shifting said position of the firing of said ink drop in response to receipt of said second firing sequence signal in a horizontal direction.

11. The method according to claim 8, wherein said shifting step comprises the further steps of shifting said position of the firing of said ink drop in response to receipt of said first firing sequence signal prior to or following said predetermined time of firing said ink drop in response to receipt of said first firing sequence signal, and shifting said position of the firing of said ink drop in response to receipt of said second firing sequence signal prior to or following said predetermined time of firing said ink drop in response to receipt of said second firing sequence signal.

12. The method according to claim 8, wherein said shifting step-further comprises the step of applying a mathematical formula.

13. The method according to claim 12, wherein said mathematical formula applying step further comprises the step of applying at least one of a sinusoidal function, a Bessel function, and a Tschebysheff polynomial.

14. The method according to claim 7, further comprising the steps of:

signaling a third firing sequence to a third set of nozzles in said printer device to fire an ink drop during a third pass of said nozzles over said portion of said print medium, wherein said third set of nozzles are operable to fire said ink drop within a predetermined time in response to receipt of said third firing sequence signal; and introducing a third controlled variance to vary said predetermined time of firing said ink drop in response to receipt of said third firing sequence signal.

15. The method according to claim 14, further comprising the steps of:

signaling a fourth firing sequence to a fourth set of nozzles in said printer device to fire an ink drop during a fourth pass of said nozzles over said portion of said print medium, wherein said fourth set of nozzles are operable to fire said ink drop within a predetermined time in response to receipt of said fourth firing sequence signal; and introducing a fourth controlled variance to vary said predetermined time of firing said ink drop in response to receipt of said fourth firing sequence signal.

16. An ink jet printer device configured to print an image by utilizing a multi-pass printing process, said device comprising:

means for firing an ink drop at a predetermined time following receipt of a fire signal;

means for varying said predetermined time of firing said ink drop in response to receipt of said fire signal, wherein said predetermined time of firing said ink drop varies for at least one pass in said multi-pass printing process.

17. The inkjet printer device of claim 16, wherein said varying means is operable to shift the predetermined time of firing said ink drop.

18. the inkjet printer device of claim 17, wherein said varying means is operable to shift said predetermined time of firing of said ink drop prior to or following said predetermined time in response to receipt of said fire signal.

19. The ink jet printer device of claim 16, wherein said varying means comprises the application of a mathematical formula.

20. The ink jet printer device of claim 19, wherein said mathematical formula comprises at least one of a sinusoidal function, a Bessel function, and a Tschebysheff polynomial.

* * * * *